US006360897B1

(12) United States Patent
Forslund et al.

(10) Patent No.: US 6,360,897 B1
(45) Date of Patent: Mar. 26, 2002

(54) SCREEN DEVICE COMPRISING TWO SCREEN CHAMBERS FOR SEPARATING FIBER SUSPENSIONS

(75) Inventors: Kjell Forslund, Sundsbruk; Klas Kriström, Kovland, both of (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/601,415

(22) PCT Filed: Mar. 4, 1999

(86) PCT No.: PCT/SE99/00320

§ 371 Date: Aug. 1, 2000

§ 102(e) Date: Aug. 1, 2000

(87) PCT Pub. No.: WO99/45193

PCT Pub. Date: Sep. 10, 1999

(30) Foreign Application Priority Data

Jun. 3, 1998 (SE) ..... 9800731

(51) Int. Cl.[7] ..... D21D 5/02; B07B 1/20

(52) U.S. Cl. ..... 210/415; 210/323.2; 209/250; 209/273; 209/306; 162/55

(58) Field of Search ..... 210/415, 497.01, 210/323.2; 209/250, 273, 306; 162/55, 251

(56) References Cited

U.S. PATENT DOCUMENTS

| | | | |
|---|---|---|---|
| 4,066,547 A | | 1/1978 | Hoks |
| 4,328,096 A | | 5/1982 | Chupka et al. |
| 4,744,894 A | * | 5/1988 | Gould |
| 5,318,186 A | | 6/1994 | Rienecker |

FOREIGN PATENT DOCUMENTS

| | | | |
|---|---|---|---|
| EP | 0145365 A2 | | 6/1985 |
| GB | 2319196 | * | 5/1998 |
| SE | 308445 B | | 2/1969 |
| WO | 95/11336 | | 4/1995 |
| WO | 97/13918 | * | 4/1997 |

* cited by examiner

*Primary Examiner*—Thomas M. Lithgow
(74) *Attorney, Agent, or Firm*—Lerner, David, Littenberg, Krumholz & Mentlik, LLP

(57) ABSTRACT

A screen device for separating fiber suspensions comprises a screen (40) defining a central chamber (36), and a rotor (15) in the central chamber having a first (21) and a second (27) rotor portion, respectively, provided with first (43) and second (41) pulsation elements, respectively, for pulsating the suspension close to the screen along a first (11) an a second (9) axial screen portion, respectively, of the screen. The first rotor portion (21) and the first axial screen portion (11) define a first screen chamber (39) and the second rotor portion (27) and the second axial screen portion (9) define a second screen chamber (37). Distribution means (22, 28) are provided for dividing the incoming fiber suspension into two part streams having the same axial directions in relation to the rotor and for distributing the two part streams to the first and second screen chambers (39, 37), respectively.

7 Claims, 2 Drawing Sheets

SCREEN DEVICE COMPRISING TWO SCREEN CHAMBERS FOR SEPARATING FIBER SUSPENSIONS

Figure 1:
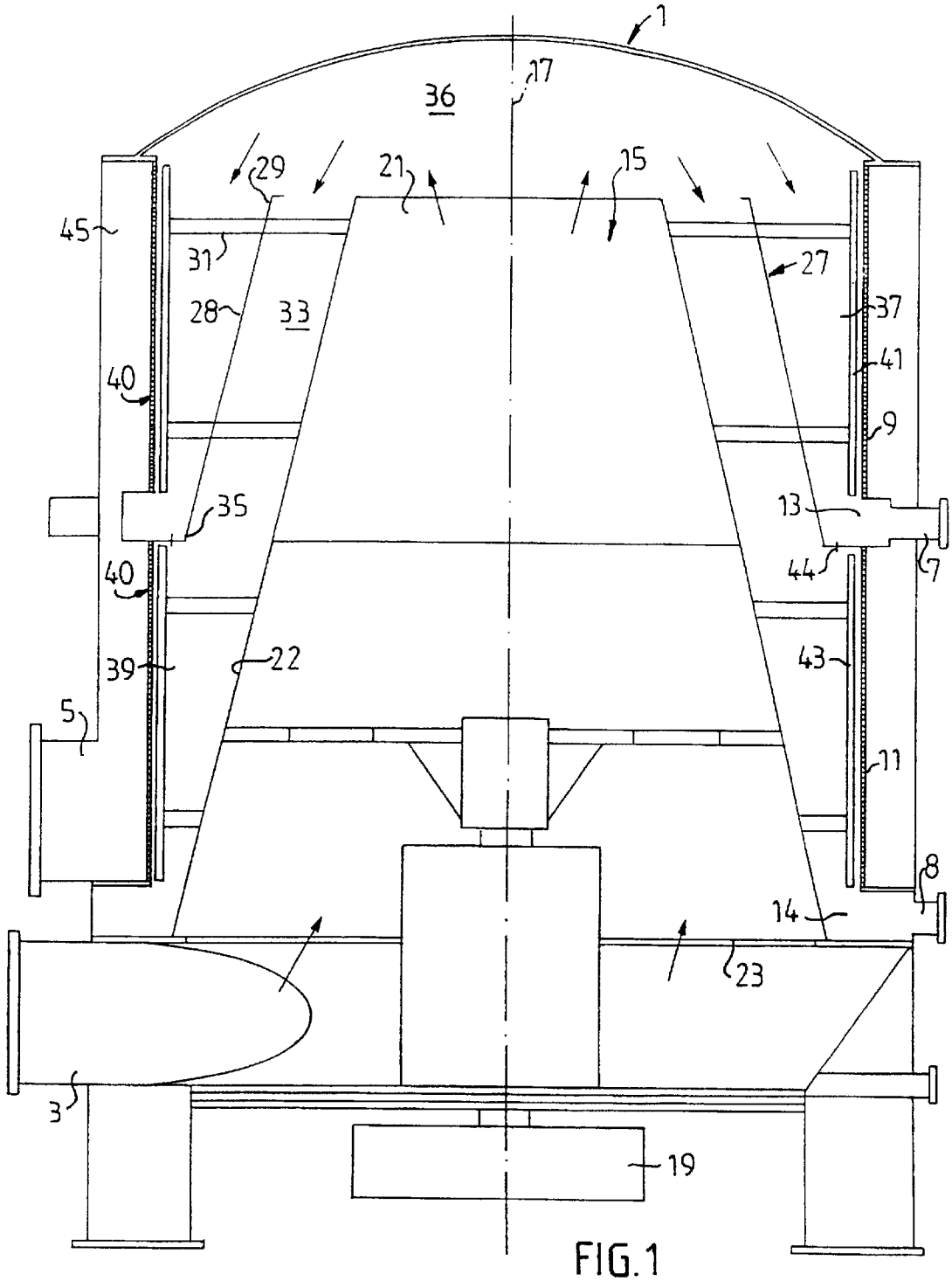

The present invention relates to a screen device for separating fiber suspensions, comprising a screen housing, a rotor situated centrally in the screen housing, a drive motor for rotating the rotor about a rotor axis, and a tubular screen concentrically surrounding the rotor and dividing the interior of the screen housing into a central chamber for receiving a fibre suspension to be separated and an outer accept chamber for receiving an accept fraction of the fibre suspension which has passed through the screen. A first rotor portion of the rotor and a first axial screen portion of the screen define a first screen chamber of the central chamber, and a second rotor portion of the rotor and a second axial screen portion of the screen define a second screen chamber of the central chamber. The screen device further comprises an inlet member for supplying the fibre suspension to be separated to the central chamber, an accept outlet member for discharging the accept fraction from the accept chamber, a first and a second reject outlet member, respectively, for discharging a reject fraction, which has not passed through the screen, from the first and the second screen chamber, respectively, first pulsation elements arranged on the first rotor portion and extending along the first axial screen portion, and second pulsation elements arranged on the second rotor portion and extending along a second axial screen portion, the pulsation elements for subjecting the fibre suspension to pulses close to the screen during rotation of the rotor.

Such a screen device, preferably a so called closed screen, is preferably used for separating pulp suspensions, for instance for fractionating fibres or separating contaminants, such as undesired particles, undefibrated material or fibre bundles. A screen device of this kind is required to be efficient, i.e. to produce an accept fraction containing as much good fibres as possible of the fibres that existed in the original fibre suspension, or in other words to produce a reject fraction containing few good fibres, preferably none at all. Also, the screen device should have a low power consumption, be space saving, be inexpensive and be service-friendly.

A problem often encountered for instance when screening paper pulp suspensions is that the consistency of the supplied suspension varies greatly. On one hand a low fibre concentration leads to a greater hydraulic load on the screen. On the other hand, a high fibre concentration requires a greater supply of energy for the operation of the screen device.

Further problems may also arise if the flow of the supplied fibre suspension varies. Thus, in the case of varying suspension flow and high fibre concentration, a too strong thickening of the fibre suspension may easily arise between the inlet member and the reject discharge members. Such a thickening of the fibre suspension limits the capacity and efficiency of the screen device, since the screen will become partly blocked by a tight fibre network. Thus, an increase in the fibre concentration has the consequence that the strength of such a fibre network formed on the screen would increase, so that the pulsation elements of the rotor would not be fully capable of dissolving the fibre network. When separating a fibre suspension having a relatively high concentration, say about 3.5%, a small increase in concentration would give rise to a large increase in the energy required for providing fluidization and breakdown of the fibre network. This has the consequence that it will be more difficult to accomplish optimal separation of high consistency suspensions than of low consistency suspensions.

Since the energy supplied by the rotor is constant along the entire extension of the screen, the fibre concentration of the fibre suspension supplied to the inlet end of the tubular screen has to be low enough so that the thickening of the fibre suspension will not be too high at the end of the screen which is opposite to the inlet end. This may result in that the energy supplied to the incoming fibre suspension will be too high causing too much fluidization of the suspension.

In order to accomplish a satisfactory separation of a high consistency fibre suspension, in certain types of screen devices the rotor previously has been provided with broad and extended pulsation elements producing prolonged suction pulses on the screen, so that a portion of the liquid which has passed through the screen into the accept fraction chamber is regained to the screen chamber. A problem in this connection however, is that the separation operation is more sensitive to disturbances with increasing consistency. To counteract disturbances when separating such high consistency fibre suspensions, the rotor has to be driven at a rotational speed that is faster than that required for separating a low consistency fibre suspension having a substantially non-fluctuating fibre concentration.

To remedy the above separation sensitive problem it has previously been suggested to divide the incoming suspension stream into two part streams, which are distributed along two relatively short portions of the screen, as seen in the axial direction, with the result that the thickening axial distance for each part stream will be relatively short. For instance, U.S. Pat. No. 4,328,096 discloses a screen device comprising a closed tank, and a vertical cylindrical screen arranged in the tank. Inside the screen there is a rotor driven by a drive motor situated under the tank. The rotor comprises a plurality of angled wings, the function of which is to split the suspension stream coming into one end of the cylindrical screen into two separate part streams, which are to flow in opposite directions in a common screen chamber along the screen. A drawback to this known screen device is among other things that the wings cannot generate any pressure or suction pulses on the screen for regaining liquid from the accept fraction chamber back to the screen chamber. This means that the fibre suspension consistency has to be relatively low. A further drawback is that the intended split of the suspension stream into said two separate part streams is difficult to achieve. It should be most unlikely that a sharp separation of the part streams is achievable. Probably, the two part streams will disturb each other already at relatively small deviations from the intended conditions (for instance fluctuations of the fibre concentration), which will disturbe the separation operation.

U.S. Pat. No. 5,318,186 discloses a screen device provided with an inlet member arranged at the middle of a cylindrical screen, for distributing incoming fibre suspension into two part streams having opposite axial flow directions in a common screen chamber. A serious drawback to this known screen device is that it requires a relatively large space because of the localisation of the inlet member. In addition, the distribution of the incoming suspension stream will probably give rise to part streams of different sizes.

The object of the present invention is to provide a screen device of the kind above discussed, which eliminates the above presented problems of the known screen devices.

This object is obtained by means of a screen device of the kind initially described, which is characterized by distribution means for dividing the fibre suspension supplied by the inlet member into two part streams having the same axial directions in relation to the rotor and for distributing the two part streams to the first and second screen chambers, respectively.

Preferably, the distribution means comprise the first and second rotor portions, which are formed with tubular coaxial walls for distributing the incoming fibre suspension from the inlet member via the interior of the tubular walls to the first and second screen chambers.

As an alternative, the distribution means may be arranged to distribute the two part streams of the fibre suspension directly to the respective screen chambers via two separate inlets, the rotor portions being designed so that the screen chambers do not communicate with each other. This alternative enables a two stage separation of the fibre suspension.

According to an embodiment of the invention the tubular wall of the second rotor portion surrounds and extends axially along the tubular wall of the first rotor portion. The tubular wall of the first and the second rotor portion, respectively, suitably has the shape of a truncated cone.

According to another embodiment of the invention, the tubular walls of the first and second rotor portions are arranged axially in succession, adjacent wall ends thereof being dimensioned such that the wall end of the first rotor portion has a less diameter than the wall end of the second rotor portion. The tubular wall of the first and the second rotor portion, respectively, suitably has the shape of a truncated cone.

The inlet member is advantageously arranged to supply the fibre suspension into the first rotor portion via the base of the conical wall thereof.

Figure 2:
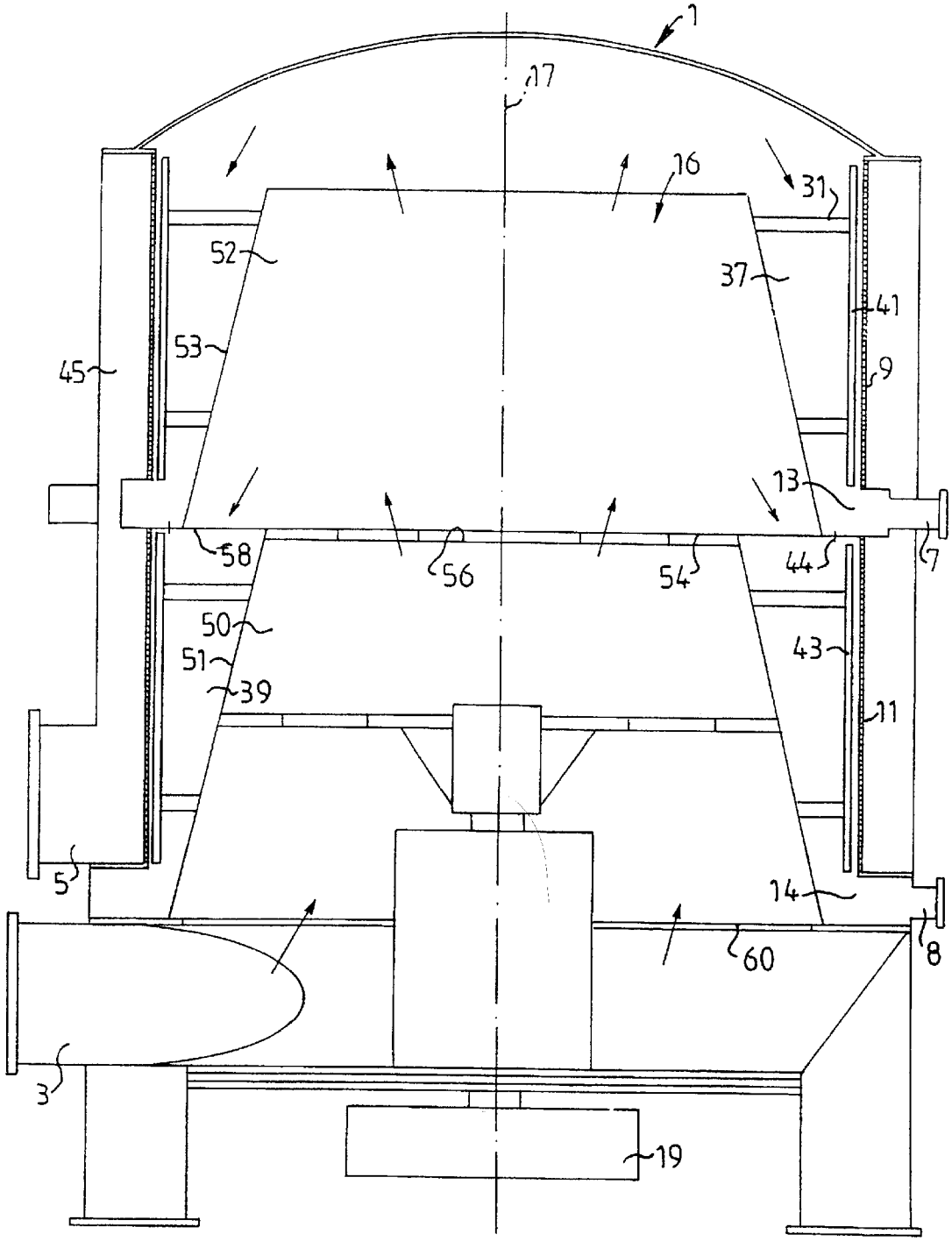

Two different preferred embodiments of the screen device according to the invention will now be described in more detail with reference to the accompanying drawings, in which FIG. 1 shows a part-sectional view of a first embodiment of the screen device according to the invention, and FIG. 2 shows a part-sectional view of a second embodiment of the screen device according to the invention.

The screen device according to FIG. 1 comprises a pressure tight screen housing 1, a lower inlet member 3 for a fibre suspension to be separated, an accept outlet member 5 for an accept fraction of the fibre suspension, an upper reject outlet member 7 and a lower reject outlet member 8 for a reject fraction of the fibre suspension. A rotationally symmetrical rotor 15 is arranged centrally in the screen housing 1 and is connected to a drive motor 19 arranged in the lower part of the screen device for rotating the rotor 15 about a vertical rotor axis 17. The rotor 15 comprises a first rotor portion 21 formed with a tubular wall 22 in the shape of a truncated cone with an undivided mantle surface. The base end 23 of the conical wall 22 forms an inlet opening which communicates with the inlet member 3, while the apex end 25 of the conical wall 22 forms an outlet opening. The rotor 15 further comprises a second rotor portion 27 which also is formed with a tubular wall 28 in the shape of a truncated cone, which has substantially the same cone angle as the conical wall 22 but which is about half as long as the latter. The top end 29 of the conical wall 28 of the second rotor portion 27 has a larger diameter than the top end 25 of the conical wall 22 of the first rotor portion 21. The conical wall 28 is coaxially secured to the conical wall 22 by means of carrier elements 31 fixed on the latter, so that both top ends 25 and 29 lie substantially in the same horizontal plane. A stationary screen 40 concentrically surrounds the rotor 15 and divides the interior of the screen housing 1 into a central chamber 36 and an outer accept chamber 45 for receiving an accept fraction which has passed through the screen 40. The accept chamber 45 surrounds the screen portions 9 and 11 to receive accept fraction for further transportation through the accept outlet member 5 connected to the accept chamber 45.

By the arrangement of conical walls 22, 28 of the rotor portions 21, 27, an annular passage 33 is formed between the conical walls 22 and 28. The passage 33 extends from the top end 29 to the base end 35 of the conical wall 28. The upper shorter conical wall 28 is surrounded by an upper cylindrical screen portion 9 of the screen 40 which is coaxial with the rotor axis 17, so that an upper screen chamber 37 is formed between the conical wall 28 and the screen portion 9. In a direct axial connection to the upper conical wall 28 there is a lower identical screen portion 11 of the screen 40 arranged coaxially with the rotor axis 17. The screen portion 11 surrounds the lower part of the longer conical wall 22 but has a somewhat shorter axial extension than said lower part.

Hereby, a lower screen chamber 39 is formed between the lower screen portion 11 and the conical wall 22, the screen chamber 39 communicating with the annular channel 33. The rotor portion 21 and 27, respectively, of the rotor 15 is provided with a number of pulsation elements 43 and 41, respectively, extending along the screen portion 11 and 9, respectively, in the screen chamber 39 and 37, respectively, for generating pressure- or suction pulses in the fibre suspension close to the screen 40 during rotation of the rotor 15.

The screen chambers 37 and 39 are sealed from each other by a sealing arrangement 44, which may comprise a flange joined to the base edge of the upper conical wall 27 and sealing to a stationary wall portion of the screen housing 1. However, the sealing arrangement 44 has no significance to the spirit of the present invention but may be designed in any known manner and is therefore not described any further.

A the lower end of each screen portion 9, 11 there is a separate reject chamber, an upper reject chamber 13 and a lower reject chamber 14. The upper chamber 13 extends into the accept chamber 45 and is connected to the reject outlet member 7 and the lower chamber 14 is arranged under the accept chamber 45 and is connected to a reject outlet member 8.

In operation, the fibre suspension flows as indicated by the arrows in the figures through the screen device. It is fed via the inlet member 3 through the opening of the base end 23 into the interior of the conical wall and flows further upwards to the opening of the top end 25. From the top end 25 the fibre suspension flows radially outwardly and is divided into two part streams of substantially the same sizes, one part stream of which flows through the annular channel 33 to the lower screen chamber 39 and the other part stream of which flows to the upper screen chamber 37. When flowing through the screen chambers 37 and 39 the part streams are affected by the pulsation elements 41 and 43, respectively, to prevent too tight fibre network from being formed on the screen 40. Reject fractions developed from the part streams of the fibre suspension are received by the reject chambers 13, 14 connected to the screen chambers 37, 39.

The second embodiment according to FIG. 2 operates in like manner as the above described first embodiment according to FIG. 1 and comprises in a large extent identical components, which have been given the same reference numerals as the corresponding components in the first embodiment. Thus, only the design of the rotor of the embodiment according to FIG. 2 differs from the embodiment according to FIG. 1.

The screen device according to FIG. 2 has a rotor 16 comprising a lower rotor portion 50 formed with a tubular wall 51 having the shape of a truncated cone, and an upper rotor portion 52 formed with a tubular wall 53 having the shape of a truncated cone. The walls 51 and 53 have substantially the same dimensions and are coaxial with the rotor axis 17 and are arranged axially in succession along the latter. Thus, the base end 54 of the upper conical wall 53 lies substantially in the same plane as the top end 56 of the lower conical wall 51. As a result, an annular passage 58 is formed between the upper and lower conical walls 51 and 53 functioning as a feed passage for a part stream of the incoming fibre suspension to the lower screen chamber 39, which is formed between the conical wall 51 and the screen portion 11. The screen chamber 37 is formed between the upper conical wall 53 and the screen portion 9.

In operation, the fibre suspension is supplied via the inlet member 3 through the opening of the lower conical wall 51 at the base end 60 into the interior of the wall 51. The fibre suspension flows further to the top end 56 of the conical wall 51, where a part stream of the suspension stream is deflected through the passage 51 to be separated in the screen chamber 39. The resulted remaining part stream of the suspension stream continues through the interior of the conical wall 53 out through the top end of the wall 53 to flow radially outwardly and further into the screen chamber 37.

Of course, the separation operation may be modified in many ways. For instance, with a suitable adaptation of the rotor the fibre suspension may enter the upper part of the screen chamber 36 and flow downwardly instead of initially flowing centrally upwardly in the central chamber 36, as in the above described embodiments, before the fibre suspension is allowed to flow downwardly to the screen chambers 37 and 39.

Furthermore, the tubular walls of the rotor portions have been described as having a truncated conical shape. The man skilled in the art should realize that this not always needs to be the case. For instance, one of the tubular walls of the rotor portions may have a cylindrical shape, but with such dimensions that suitable inflowing passages to the screen chambers exist. With the above stated prerequisites it is also conceivable to design both tubular walls of the rotor portions with cylindrical shapes.

An important advantage which is obtained in addition to the more efficient separation with the divided rotor according to the invention, especially where the available space is limited, is that the screen device by the divided design can be more easily mounted.

The design with a divided rotor and screen can be utilized when constructing large screen devices by first constructing a "half" screen unit solely consisting of one rotor portion and one screen portion, whereafter a further rotor portion and a screen portion may be mounted when need for a larger capacity arises.

Besides, there is nothing to prevent more than two rotor portions and two screen portions according to the last described second embodiment from being mounted together in one screen device.

By the fact that the incoming fibre suspension flows upwards and turns 180° at the roof of the screen device, a certain deaeration of the fibre suspension takes place here, which enables separation of air through a deaeration outlet arranged for instance centrally in the roof. In addition such a deaeration outlet may be utilized for separating a light reject fraction from the fibre suspension.

The embodiments according to FIGS. 1 and 2 have been described in accordance with a vertical configuration, i.e. the rotor axis extends vertically. However, as an alternative they may be oriented such that the rotor axis extends horizontally.

What is claimed is:

1. A screen apparatus for separating fiber suspensions, comprising:

a housing;

a rotor situated centrally in said housing, said rotor including a first rotor portion and a second rotor portion;

a drive motor for rotating said rotor about a rotor axis;

a tubular screen including a first axial screen portion and a second axial screen portion, said tubular screen centrally surrounding said rotor and dividing the interior of said housing into a central chamber for receiving a fiber suspension to be separated and an outer accept chamber for receiving an accept fraction of said fiber suspension which has passed through said screen, said first rotor portion of said rotor and said first axial screen portion of said screen defining a first screen chamber of said central chamber, and said second rotor portion of said rotor and said second axial screen portion of said screen defining a second screen chamber of said central chamber;

an inlet member for supplying said fiber suspension to be separated to said central chamber;

an accept outlet member for discharging said accept fraction from said accept chamber;

first and second reject outlet members for discharging a reject fraction which has not passed through said screen from said first and second screen chambers, respectively;

first pulsation elements extending along said first axial screen portion and rotatable with said first rotor portion;

second pulsation elements extending along said second axial screen portion and rotatable with said second rotor portion, said pulsation elements adapted to subject said fiber suspension to pulses close to said screen during rotation of said rotor; and a distribution device which divides said fiber suspension supplied by said inlet member into two part streams having the same axial directions in relation to said rotor and distributes said two part streams to said first and second screen chambers, respectively, wherein said distribution device comprises said first and second rotor portions, said first rotor portion comprising a first tubular wall and said second rotor portion comprising a second tubular wall, thereby providing coaxial tubular walls for distributing the incoming fiber suspension from said inlet member through the interior of said tubular walls to said first and second screen chambers, and wherein said second tubular wall surrounds and extends coaxially along said first tubular wall.

2. A screen apparatus according to claim 1, wherein said tubular wall of said first and second rotor portion, respectively, takes the shape of a truncate cone.

3. A screen apparatus for separating fiber suspensions, comprising:

a housing;

a rotor situated centrally in said housing, said rotor including a first rotor portion and a second rotor portion;

a drive motor for rotating said rotor about a rotor axis;

a tubular screen including a first axial screen portion and a second axial screen portion, said tubular screen centrally surrounding said rotor and dividing the interior of said housing into a central chamber for receiving a fiber suspension to be separated and an outer accept chamber for receiving an accept fraction of said fiber suspension which has passed through said screen, said first rotor portion of said rotor and said first axial screen portion of said screen defining a first screen chamber of said central chamber, and said second rotor portion of said rotor and said second axial screen portion of said screen defining a second screen chamber of said central chamber;

an inlet member for supplying said fiber suspension to be separated to said central chamber;

an accept outlet member for discharging said accept fraction from said accept chamber;

first and second reject outlet members for discharging a reject fraction which has not passed through said screen from said first and second screen chambers, respectively;

first pulsation elements extending along said first axial screen portion and rotatable with said first rotor portion;

second pulsation elements extending along said second axial screen portion and rotatable with said second rotor portion, said pulsation elements adapted to subject said fiber suspension to pulses close to said screen during rotation of said rotor; and a distribution device which divides said fiber suspension supplied by said inlet member into two part streams having the same axial directions in relation to said rotor and distributes said two part streams to said first and second screen chambers, respectively, wherein said distribution device comprises said first and second rotor portions, said first rotor portion comprising a first tubular wall and said second rotor portion comprising a second tubular wall, thereby providing coaxial tubular walls for distributing said incoming fiber suspension from said inlet member through the interior of said first and second tubular walls to said first and second screen chambers, and wherein said first and second tubular walls include first and second adjacent wall ends, respectively, said first wall end having a lesser diameter than said second wall end.

4. A screen apparatus according to claim 3, wherein said first and second tubular walls take the shape of a truncated cone.

5. A screen apparatus according to claim 4, wherein said first and second conical walls are identical.

6. A screen apparatus for separating fiber suspensions, comprising:

a housing;

a rotor situated centrally in said housing, said rotor including a first rotor portion and a second rotor portion;

a drive motor for rotating said rotor about a rotor axis;

a tubular screen including a first axial screen portion and a second axial screen portion, said tubular screen centrally surrounding said rotor and dividing the interior of said housing into a central chamber for receiving a fiber suspension to be separated and an outer accept chamber for receiving an accept fraction of said fiber suspension which has passed through said screen, said first rotor portion of said rotor and said first axial screen portion of said screen defining a first screen chamber of said central chamber, and said second rotor portion of said rotor and said second axial screen portion of said screen defining a second screen chamber of said central chamber;

an inlet member for supplying the fiber suspension to be separated to said central chamber;

an accept outlet member for discharging said accept fraction from said accept chamber;

first and second reject outlet members for discharging a reject fraction which has not passed through said screen from said first and second screen chambers, respectively;

first pulsation elements extending along said first axial screen portion and rotatable with said first rotor portion;

second pulsation elements extending along said second axial screen portion and rotatable with said second rotor portion, said pulsation elements adapted to subject the fiber suspension to pulses close to said screen during rotation of said rotor; and a distribution device which divides said fiber suspension supplied by said inlet member into two part streams having the same axial directions in relation to said rotor and distributes said two part streams to said first and second screen chambers, respectively, wherein said distribution device comprises said first and second rotor portions, said first and second rotor portions comprising a first tubular wall and said second rotor portion comprising a second tubular wall, thereby providing coaxial tubular walls for distributing said incoming fiber suspension from said inlet member through the interior of said first and second tubular walls to said first and second screen chambers, and wherein said first and second tubular walls take the shape of a truncated cone and said first and second screen portions are cylindrical, whereby said first and second screen chambers taper in a direction towards the base of said first and second conical walls and said first and second reject outlet members are provided for discharging said reject fraction from a relatively narrower part of said first and second screen chambers, respectively.

7. A screen apparatus according to claim 6, wherein said inlet member is provided for supplying said fiber suspension into said first rotor portion through the base of said first conical wall thereof.

* * * * *